US011395081B2

(12) United States Patent
Lo et al.

(10) Patent No.: US 11,395,081 B2
(45) Date of Patent: Jul. 19, 2022

(54) ACOUSTIC TESTING METHOD AND ACOUSTIC TESTING SYSTEM THEREOF

(71) Applicant: xMEMS Labs, Inc., Santa Clara, CA (US)

(72) Inventors: Chiung C. Lo, San Jose, CA (US); Yuan-Shuang Liu, Hsinchu County (TW); David Hong, Los Altos, CA (US)

(73) Assignee: xMEMS Labs, Inc., Santa Clara, CA (US)

( * ) Notice: Subject to any disclaimer, the term of this patent is extended or adjusted under 35 U.S.C. 154(b) by 0 days.

(21) Appl. No.: 17/009,789

(22) Filed: Sep. 2, 2020

(65) Prior Publication Data

US 2021/0377679 A1 Dec. 2, 2021

Related U.S. Application Data

(60) Provisional application No. 63/030,913, filed on May 27, 2020.

(51) Int. Cl.
*H04R 29/00* (2006.01)
*H04R 1/28* (2006.01)

(52) U.S. Cl.
CPC ..... *H04R 29/001* (2013.01); *H04R 1/2803* (2013.01)

(58) Field of Classification Search
CPC ..... H04R 29/001; H04R 1/2803
USPC ..... 381/59, 58, 150, 122, 152, 56; 702/103, 702/104, 108; 703/570, 579
See application file for complete search history.

(56) References Cited

U.S. PATENT DOCUMENTS

2001/0046720 A1* 11/2001 Ostapenko ..... H01L 21/67253 438/14
2002/0048219 A1* 4/2002 Ladabaum ..... B06B 1/0681 367/162
2004/0113640 A1* 6/2004 Cooper ..... G01R 31/2886 324/750.25
2013/0142360 A1* 6/2013 Potard ..... H03G 9/18 381/98
2015/0130498 A1* 5/2015 Wang ..... G01R 31/2891 324/756.03

* cited by examiner

*Primary Examiner* — Vivian C Chin
*Assistant Examiner* — Con P Tran
(74) *Attorney, Agent, or Firm* — Winston Hsu

(57) ABSTRACT

An acoustic testing method includes providing an electrical signal to a wafer, receiving a sound wave generated by the acoustic transducer according to the electrical signal, and generating a sensing result for determining an acoustic functionality of the acoustic transducer. The wafer includes a plurality of acoustic transducers, and the electrical signal is provided to an acoustic transducer within the wafer.

21 Claims, 6 Drawing Sheets

ACOUSTIC TESTING METHOD AND ACOUSTIC TESTING SYSTEM THEREOF

CROSS REFERENCE TO RELATED APPLICATIONS

This application claims the benefit of U.S. provisional application No. 63/030,913, filed on May 27, 2020, which is incorporated herein by reference.

BACKGROUND OF THE INVENTION

1. Field of the Invention

The present invention relates to an acoustic testing method and acoustic testing system thereof, and more particularly, to an acoustic testing method and acoustic testing system thereof capable of increasing testing efficiency.

2. Description of the Prior Art

The design challenge for producing high-fidelity sound by the conventional speaker is its enclosure. Normally, a speaker cannot be used without installing it in the speaker enclosure (or an acoustic resonator). The speaker enclosure is often used to contain the back-radiating wave of the produced sound to avoid cancelation of the front radiating wave in certain frequencies where the corresponding wavelengths of the sound are significantly larger than the speaker dimensions. The speaker enclosure can also be used to help improving, or reshaping, the low-frequency response, for example, in a bass-reflex (ported box) type enclosure where the resulting port resonance is used to invert the phase of back-radiating wave and achieves an in-phase adding effect with the front-radiating wave around the port-chamber resonance frequency. On the other hand, in an acoustic suspension (closed box) type enclosure, the enclosure functions as a spring which forms a resonance circuit with the vibrating membrane. With properly selected speaker driver and enclosure parameters, the combined enclosure-driver resonance peaking can be leveraged to boost the output of sound around the resonance frequency and therefore improves the performance of resulting speaker.

The testing of the conventional speaker can bring various challenges and costs time, money and effort. Since the conventional speaker requires the speaker enclosure, the conventional speaker is tested and calibrated after the speaker has been installed in the speaker enclosure. A disadvantage of this approach is that a defective speaker is recognized only after installation/assembly. This causes a cost increase because the defective speaker must be discarded together with the speaker enclosure. Therefore, how to test a sound producing device is an important objective in the field.

SUMMARY OF THE INVENTION

It is therefore a primary objective of the present invention to provide an acoustic testing method and acoustic testing system thereof capable of increasing testing efficiency.

An embodiment of the present invention provides an acoustic testing method. The acoustic testing method comprises providing an electrical signal to a wafer, wherein the wafer comprises a plurality of acoustic transducers, and the electrical signal is provided to an acoustic transducer within the wafer; and receiving a sound wave generated by the acoustic transducer according to the electrical signal, and generating a sensing result for determining an acoustic functionality of the acoustic transducer.

Another embodiment of the present invention provides an acoustic testing system. The acoustic testing system comprises a wafer, wherein a plurality of acoustic transducers is formed within the wafer, and an acoustic transducer within the wafer receives an electrical signal; and a sound sensing device, configured to receive a sound wave generated by the acoustic transducer according to the electrical signal, and generate a sensing result for determining an acoustic functionality of the acoustic transducer.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
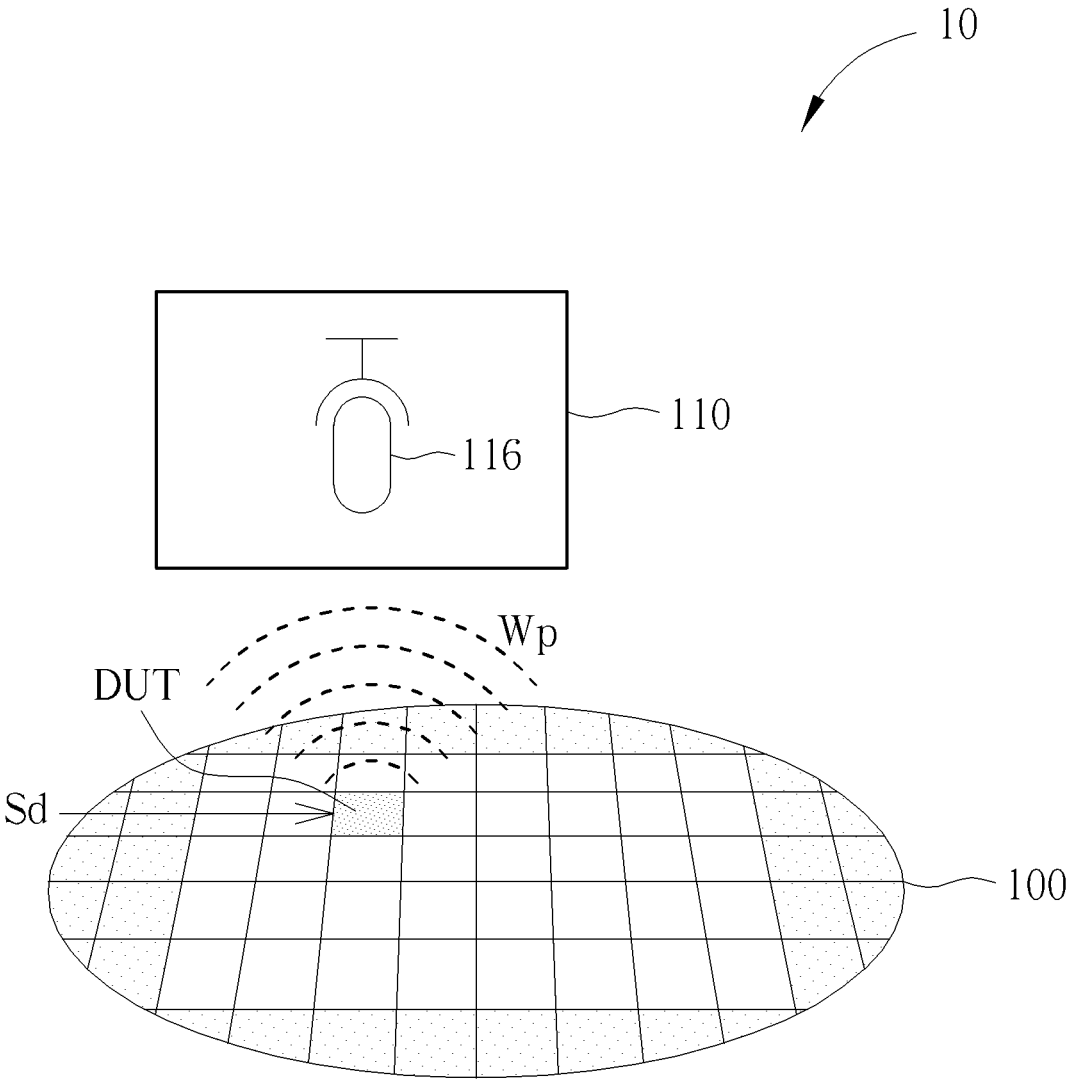
FIG. 1 to FIG. 6 are schematic diagrams of acoustic testing systems according to embodiments of the present invention respectively.

FIG. 1 is a schematic diagram of an acoustic testing system 10 according to an embodiment of the present invention. The acoustic testing system 10 comprises a wafer 100 and an acoustic testing apparatus 110. The wafer 100 (also referred to as semiconductor wafer) comprises a plurality of acoustic transducers DUT (also referred to as die). Each acoustic transducer DUT may produce a sound/acoustic wave Wp after receiving an electrical signal Sd. The acoustic testing apparatus 110 may comprise a sound sensing device 116, and is utilized to perform acoustic testing corresponding to the electrical signal Sd on the wafer 100.

Briefly, each acoustic transducer DUT may be able to convert the electrical signal Sd into the sound wave Wp. The acoustic testing apparatus 110 may detect the sound wave Wp at wafer level (or before the conventional wafer dicing process), so as to verify the acoustic functionality of each of the acoustic transducer DUT. Therefore, cost in time, money and effort may be reduced.

Conventionally, a manufacturing process (by which a wafer is formed), a conventional wafer testing process (by which circuit behavior of each die on the wafer is electrically tested and measured), the conventional wafer dicing process, a conventional packaging process (by which each separated die is packaged), an conventional installation/assembly process (by which each separated die is mounted in an enclosure), and a conventional acoustic testing are performed and follow the sequence outlined above. The conventional acoustic testing must follow the conventional assembly process because only with the enclosure can the conventional acoustic testing be practical and worthwhile.

Different from the conventional acoustic testing, coming after the conventional wafer dicing process and the conventional assembly process, the acoustic testing apparatus 110 of the present invention performs the acoustic testing, along with the conventional wafer testing process, at wafer level to increase testing efficiency and smoothen overall process.

The acoustic testing (or the conventional acoustic testing) may involve sound intensity, sound power, sound quality, or sound spectral measurement. The conventional wafer testing process focuses on circuit behavior such as connectivity, sensitivity, capacitance, resonance frequency, −3 dB frequency, frequency response, and quality factor. The conventional wafer testing process may include, for instance, wafer sort, wafer final test, electronic die sort, and circuit probe.

Figure 2:
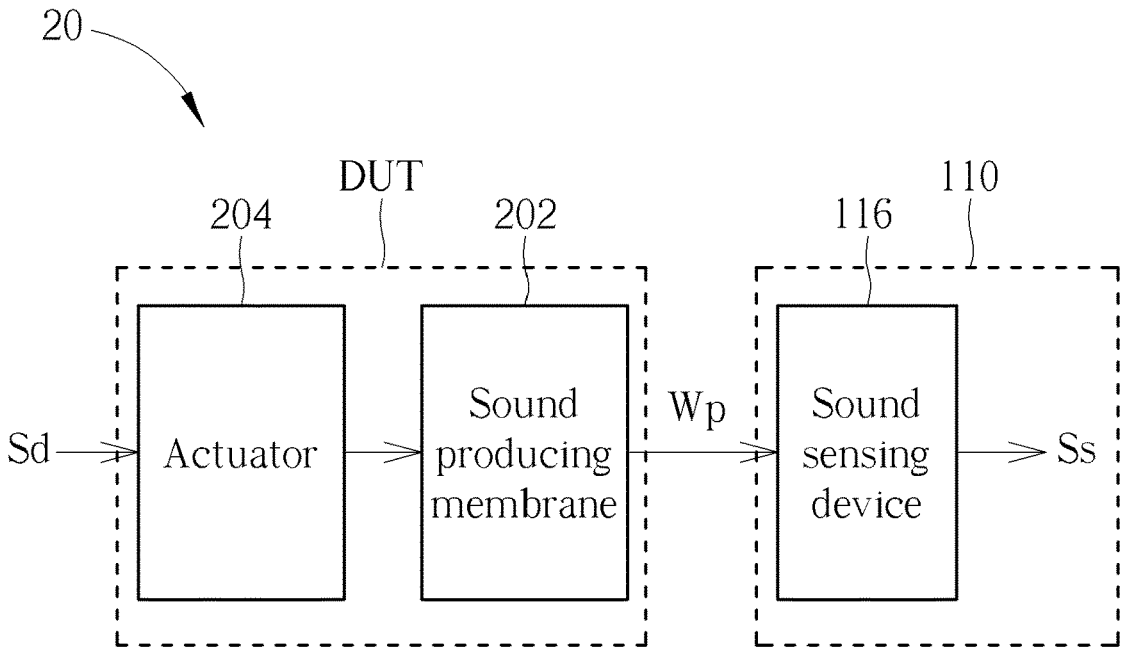

FIG. 2 is a schematic diagram of an acoustic testing system 20 according to an embodiment of the present invention. In FIG. 2, the sound sensing device 116 of the acoustic testing system 20 may be a microphone. The sound sensing device 116 may measure the sound wave Wp produced by the acoustic transducer DUT within the wafer 100 and convert the sound wave Wp into an electrical signal Ss (also referred to as a second electrical signal). The acoustic testing apparatus 110 may analyze the electrical signal Ss to verify acoustic functionality of the acoustic transducer DUT. For example, the acoustic testing apparatus 110 may check whether the acoustic transducer DUT within the wafer 100 is able to produce sound. Alternatively, the acoustic testing apparatus 110 may determine whether the sound pressure level (SPL) of the sound wave Wp produced by the acoustic transducer DUT within the wafer 100 exceeds certain threshold, such as 55 decibel (dB).

Optionally, the acoustic testing apparatus 110 may compare voltage or current of the electrical signal Ss with a reference value. Optionally, the acoustic testing apparatus 110 may determine whether distortion is created or increased. Optionally, the SPL or waveform of the sound wave Wp may be assessed according to factory specifications to determine whether to pass or fail the acoustic transducer DUT.

In FIG. 2, each of the acoustic transducers DUT may be a sound producing device (SPD) (for example, a speaker). The acoustic transducer DUT may have high acoustic quality even if an enclosure or an acoustic resonator is absent from the acoustic transducer DUT. For example, the SPL of the sound wave Wp produced by the acoustic transducer DUT alone is high enough. Alternatively, the acoustic transducer DUT produces the sound wave Wp with little or no distortion. Therefore, the acoustic testing apparatus 110 performs acoustic testing on the acoustic transducer DUT at wafer level, or before the acoustic transducer DUT is assembled in an enclosure or an acoustic resonator. When the acoustic transducer DUT passes the acoustic testing at wafer level, the acoustic transducer DUT may be delivered to an end consumer without further acoustic testing. The acoustic testing apparatus 110 does not perform acoustic testing on the acoustic transducer DUT mounted in an enclosure or an acoustic resonator.

To overcome the design challenges of speaker driver and enclosure within the sound producing industry, applicant provides the sound producing micro-electrical-mechanical-system (MEMS) device in U.S. application Ser. No. 16/125,761, so as to produce sound in an air pulse rate/frequency, where the air pulse rate is higher than the maximum human audible frequency, sometimes reaching an ultrasonic frequency.

A force-based sound producing apparatus/device and a position-based sound producing apparatus/device are provided in U.S. application Ser. No. 16/420,141 and Ser. No. 16/420,190, which can be used as a realization of the acoustic transducer of the present invention and are incorporated herein by reference. In the force-based sound producing apparatus, the force-based SPD is directly driven by a pulse amplitude modulated (PAM) driving signal. In the position-based apparatus, a MEMS SPD is utilized and a summing module therein is utilized to convert the PAM driving signal to the driving voltage to drive the membrane within the MEMS SPD to achieve a certain position.

To enhance sound quality, an SPD disclosed by U.S. application Ser. No. 16/920,384, which may be also used as a realization of the acoustic transducer of the present invention and is incorporated herein by reference. A MEMS chip configured to produce sound wave is formed of a silicon wafer by at least one semiconductor process.

As shown in FIG. 2, the acoustic transducer DUT may comprises a sound producing membrane 202, an actuator 204 attached to the sound producing membrane 202, or circuit(s). The actuator 204 is configured to receive an electrical signal (for example, the electrical signal Sd), such that the acoustic transducers DUT is able to produce a plurality of air pulses at an air pulse rate, where the air pulse rate is higher than a maximum human audible frequency, like what U.S. application Ser. No. 16/125,761 does. More specifically, the plurality of air pulses and the air pulse array produced by the acoustic transducer DUT of the present application would inherit the air pulse characteristics of U.S. applications Ser. Nos. 16/125,761, 16/420,141, 16/420,190 and 16/420,184, in which each one of the plurality of air pulses generated by the acoustic transducer DUT of the present application would have non-zero offset in terms of SPL, where the non-zero offset is a deviation from a zero SPL. The amplitude of each air pulse and its non-zero offset may be proportional to amplitudes of the electrical signal Sd sampled at the said air pulse rate. In addition, the plurality of air pulses generated by the acoustic transducer DUT of the present application is aperiodic over a plurality of pulse cycles. Details of the "non-zero SPL offset" and the "aperiodicity" properties may be referred to U.S. application Ser. No. 16/125,761, which are not narrated herein for brevity.

The acoustic testing mentioned above on the acoustic transducers DUT is initiated after the manufacturing process is completed. The acoustic transducers DUT may be manufactured using thin film techniques or micromachining fabrication techniques such as typical MEMS processes at wafer level similar to those used for integrated circuits. The acoustic transducers DUT may be a lead zirconate titanate ($PbZr_{(x)}Ti_{(1-x)}O_3$ or PZT) actuated MEMS device, which may be fabricated from an silicon on insulator (SOI) wafers with silicon (Si) thickness as 3~6 μm and a PZT layer of thickness of 1 to 2 micrometer (μm), for example. All the acoustic transducers DUT are simultaneously fabricated on the wafer 100. To manufacture one of the acoustic transducers DUT, each sound producing membrane 202 may be formed during the manufacturing process of the circuit(s). That is to say, the sound producing membrane 202, the actuator 204, and the circuit(s) are integrated together instead of being fabricated from individual discrete parts, and this monolithic nature ensure higher yield and lower cost.

Figure 3:
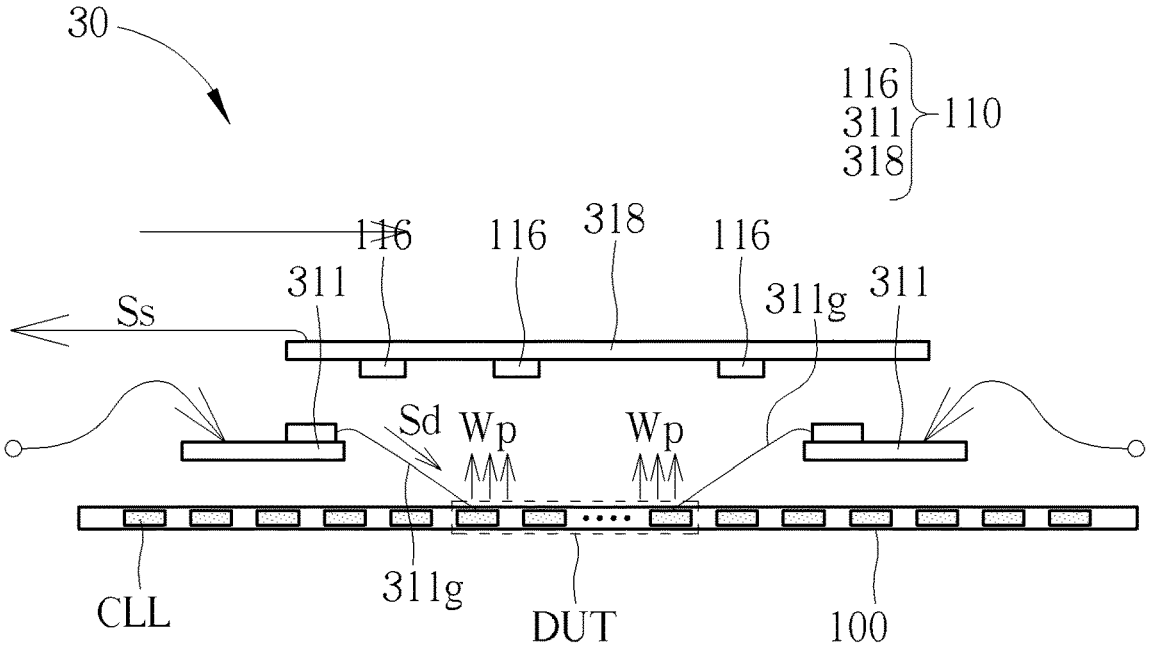

FIG. 3 is a schematic diagram of an acoustic testing system 30 according to an embodiment of the present invention. As shown in FIG. 3, the acoustic testing apparatus 110 of the acoustic testing system 30 may comprise a plurality of sound sensing devices 116, a probe card 311, and a frame 318. In some embodiments, the acoustic testing apparatus 110 may further comprise a wafer prober, a tester, or a microscope. The sound sensing devices 116 configured to detect the sound wave Wp produced by the acoustic transducer DUT within the wafer 100 may be arranged in an array and disposed on the frame 318 above the probe card 311. Alternatively, the sound sensing devices 116 may be randomly distributed on the frame 318. The more the sound sensing devices 116, the higher the testing efficiency, coverage, or accuracy may be. The frame 318 is configured to provide electrical connections and mechanical support. In some embodiments, the frame 318 may be another probe card different from the probe card 311.

The probe card 311 is configured to provide the electrical signal Sd to the wafer 100. The probe card 311 configured to test the wafer 100 may comprise a plurality of probes 311*g* that extend downwards from the probe card 311. The probes 311*g* may be microscopic electronic contacts for making electrical contact with electronic pads of the acoustic transducers DUT on the wafer 100 to allow signal transmission. Before, when, or after the probe card 311 triggers one of the acoustic transducers DUT within the wafer 100 by the electrical signal Sd, the probe card 311 may perform the conventional wafer testing process on the acoustic transducer DUT at wafer level to check whether the acoustic transducer DUT meets (electrical characteristics) requirements. In the conventional wafer testing process, the probe card 311 may input electrical signal(s) (which may be the electrical signal Sd or another electrical signal) to and receive electrical feedback(s), which belong to electrical signal(s), from the acoustic transducer DUT being tested on the wafer 100 via the probes 311*g* so as to identify faults in the acoustic transducer DUT (namely, for electrical measurements).

While all the acoustic transducers DUT are still on/within the wafer 100, the acoustic transducers DUT are tested (electrically checked by the conventional wafer testing process and acoustic checked by the acoustic testing) and nonfunctional/malfunctional acoustic transducer(s) DUT are identified. In other words, during testing, the sound sensing device 116 may keep detecting the sound wave Wp produced from the sound producing membrane 202 being triggered to vibrate, and the probe card 311 may keep detecting the electrical feedback(s) from the probe(s) 311*g*. Subsequently, the wafer 100 is sliced into individual acoustic transducers DUT. Nonfunctional acoustic transducer(s) DUT are discarded; functional acoustic transducer(s) DUT are sent on to be assembled into (plastic) packages and then delivered to an end consumer. Because the testing takes place before the acoustic transducers DUT are split by, for instance, a diamond saw, it can be easier and more accurately for an processing circuit of the acoustic testing apparatus 110 to localize all the acoustic transducers DUT on the same wafer 100 and for the probe 311*g* to contact the electronic pads of the acoustic transducers DUT. Instead of performing the conventional wafer testing process and the acoustic testing separately, the acoustic testing apparatus 110 of the present invention performs the acoustic testing, along with the conventional wafer testing process, at wafer level to increase testing efficiency.

As shown in FIG. 3, the acoustic transducers DUT may comprise a plurality of cells CLL. Each cell CLL may comprise a membrane layer, a bottom electrode layer, an actuator layer, and a top electrode layer, which may be stacked in sequence. The actuator layer sandwiched between the bottom electrode layer and the top electrode layer may comprise a piezoelectric layer. The bottom electrode layer, the actuator layer, and the top electrode layer may constitute the actuator 204 and may be disposed on the membrane layer, which may serve as the sound producing membrane 202, by means of, for instance, chemical vapor deposition (CVD), physical vapor deposition (PVD) sputtering or sol-gel spin coating. The electrical signal (for example, the electrical signal Sd) is applied between the bottom electrode layer and the top electrode layer to cause a deformation of the piezoelectric layer. Deformation of the actuator 204 may cause the membrane layer to deform and result in its surface moving upwards or downwards, particularly to a specific position according to the electrical signal. Moreover, the specific position of the membrane layer is proportional to the electrical signal applied to the actuator 204.

In some embodiments, provided the response time of membrane movements is significant shorter than a pulse cycle time, such movements of the membrane layer over a plurality of pulse cycles would produce a plurality of air pulses at an air pulse rate, which is the inverse of the pulse cycle time.

Figure 4:
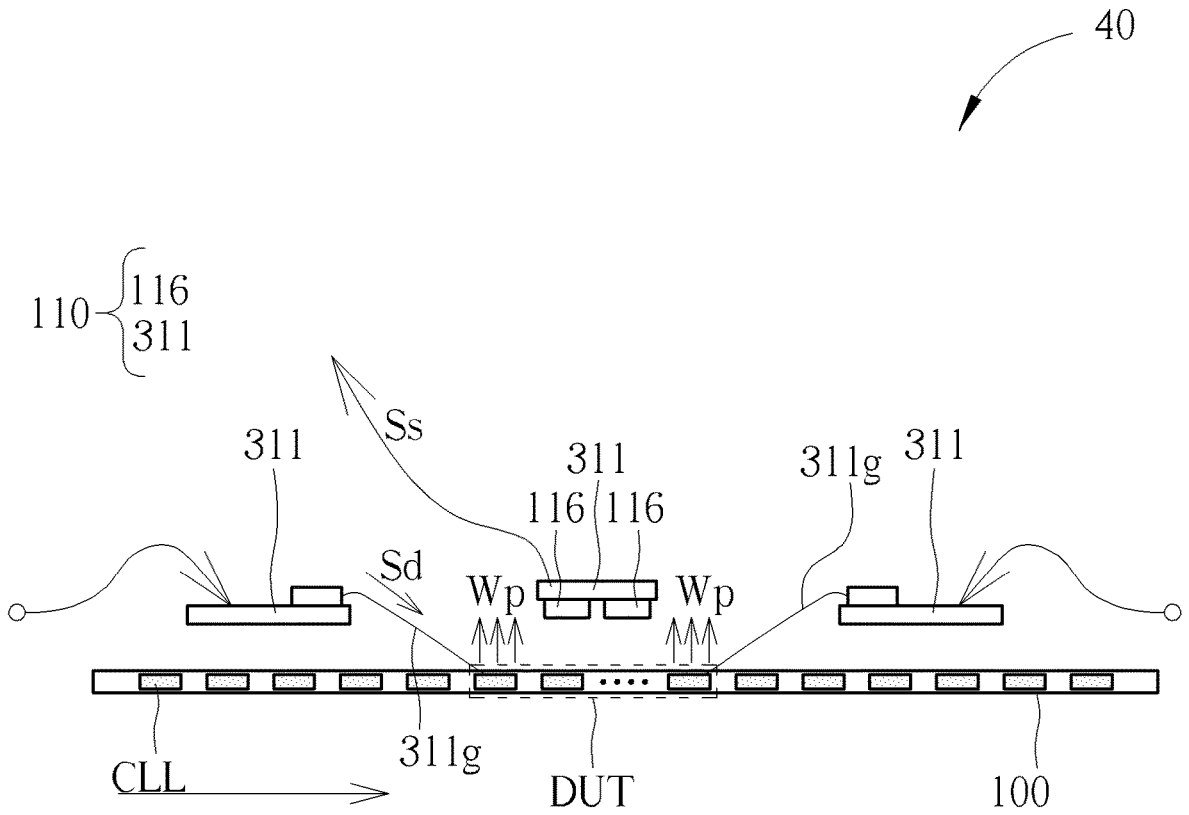

FIG. 4 is a schematic diagram of an acoustic testing system 40 according to an embodiment of the present invention. Distinct from the acoustic testing system 30, the sound sensing devices 116 of the acoustic testing system 40 are located on the probe card 311 to capture the sound wave Wp produced by the acoustic transducer DUT within the wafer 100. In other words, the frame 318 of the acoustic testing system 30 is optional and may/can be removed. The probe card 311 alone may provide electrical connections and mechanical support for the sound sensing devices 116. Because the sound sensing devices 116 of the acoustic testing system 40 is disposed closer to the wafer 100, the sound sensing devices 116 of the acoustic testing system 40 may hear/receive the sound wave Wp more clearly.

Figure 5:
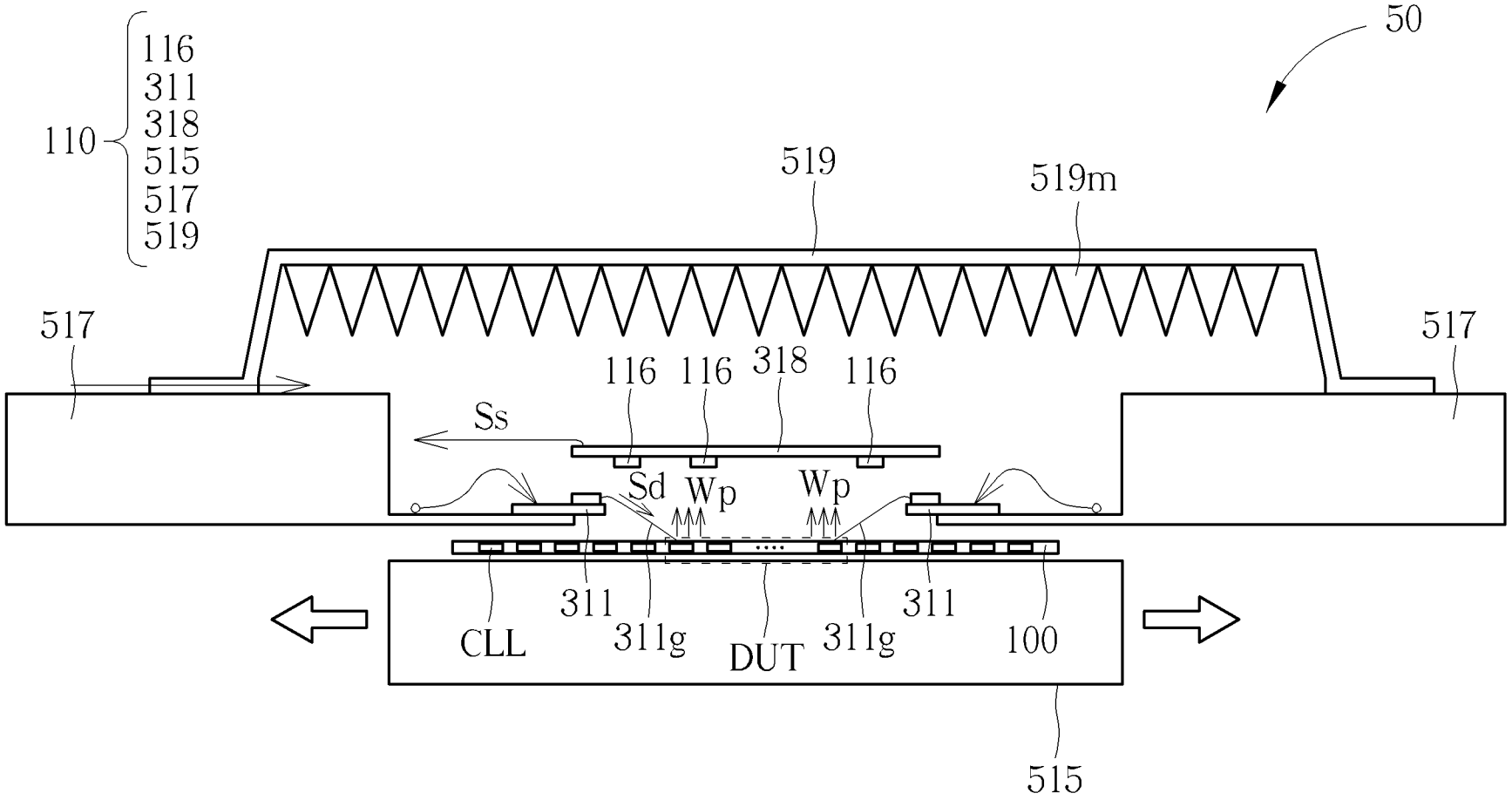

FIG. 5 is a schematic diagram of an acoustic testing system 50 according to an embodiment of the present invention. Besides the sound sensing devices 116, the probe card 311, and the frame 318, the acoustic testing apparatus 110 of the acoustic testing system 50 may comprise a probe chuck 515, a probe card holder 517, and a noise isolation cover 519. The wafer 100 may be enclosed by the probe chuck 515, the probe card holder 517, and the noise isolation cover 519. The acoustic testing apparatus 110 may not be sealed by the noise isolation cover 519. The noise isolation cover 519 is configured to surround the wafer 100 or close off the acoustic testing apparatus 110 on several sides so as to achieve noise isolation and increase signal to noise ratio. The noise isolation cover 519 may comprise soundproofing material 519*m*, such that ambient acoustic noise and vibration as seen by the acoustic transducer DUT are reduced. The soundproofing material 519*m* may have a structure of periodic solids, for example, a saw-tooth-shaped or pyramid array structure. The structural periodicity of the soundproofing material 519*m* may cause destructive interference between transmitted and reflected waves, thereby preventing specific wave types from propagating. The probe card holder 517 may form a part of the wafer prober. The probe card 311 may be fastened to the probe card holder 517 so as to be held in place during testing.

The probe chuck 515 is configured to support the wafer 100. The wafer 100 may be held onto the probe chuck 515, for example, via vacuum pressure. The prober chuck 515 may control and limit movement of the wafer 100 and thus enable sequential wafer-level testing (namely, the acoustic testing and the conventional wafer testing process) from one acoustic transducer DUT to the next. After one acoustic transducer DUT has been tested, the probe chuck 515 may move the wafer 100 vertically or laterally to the next acoustic transducer DUT with respect to the probe card 311 to start next testing. For example, the wafer 100 may move downwards away from tips of the probes 311*g*, then move towards the left (or right) with respect to the probe card 311, and then move upwards and back to the tips of the probes 311*g*. In this case, one acoustic transducer DUT receives the electrical signal Sd from the probe card 311 before the next acoustic transducer DUT receives the electrical signal Sd from the probe card 311. That is, all the acoustic transducers DUT receive the electrical signal Sd respectively in sequence (one by one) according to movement of the wafer 100. In an embodiment, the probe chuck 515 may be positioned by an optical device such that the probes 311g is able to contact the electronic pads of the acoustic transducers DUT on the wafer 100 precisely. The sound sensing devices 116 and the probe card 311 are firmly fixed without moving to ensure consistent test quality.

Figure 6:
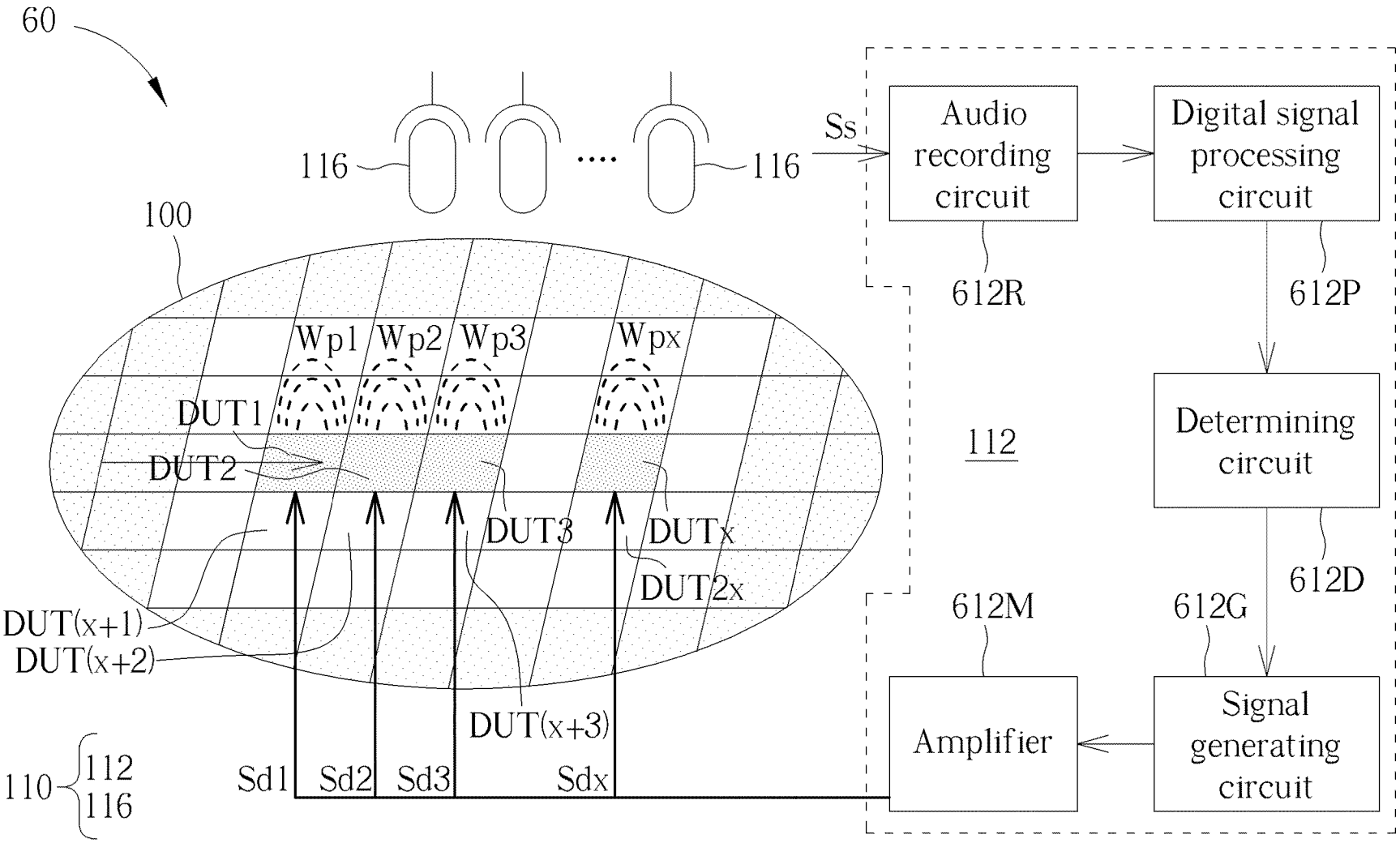

FIG. 6 is a schematic diagram of an acoustic testing system 60 according to an embodiment of the present invention. The acoustic transducers DUT constituting the wafer 100 as shown in FIG. 1 may be named as acoustic transducers DUT1-DUTn. Distinct from the acoustic testing system 10, the testing (namely, the acoustic testing and the conventional wafer testing process) of several acoustic transducers (for example, the acoustic transducers DUT1-DUTx) of the acoustic testing system 60 may take place in parallel on the wafer 100. Specifically, a processing circuit 112 of the acoustic testing apparatus 110 or the probe card 311 may transmit electrical signals Sd1-Sdx, which correspond to different frequencies, to the acoustic transducers DUT1-DUTx respectively at a time. The acoustic transducers DUT1-DUTx may receive the electrical signals Sd1-Sdx respectively at the same time, and produce sound waves Wp1-Wpx corresponding to the electrical signals Sd1-Sdx respectively. The sound sensing devices 116 may detect the sound waves Wp1-Wpx, which correspond to frequencies different from each other, at a time. The parallelization of testing the acoustic transducers DUT1-DUTx may reduce the testing cost and time in an efficient manner. Before, when, or after the acoustic transducers DUT1-DUTx within the wafer 100 are triggered by the electrical signals Sd1-Sdx, the conventional wafer testing process may be performed on the acoustic transducers DUT1-DUTx at wafer level respectively as well.

After the acoustic transducers DUT1-DUTx have been tested, the probe chuck 515 may move the wafer 100 vertically or laterally to the next the acoustic transducers DUT(x+1)-DUT2*x* to start next testing. Because more than one acoustic transducers (for instance, the acoustic transducers DUT1-DUTx) are tested at a time, testing efficiency is improved. By providing electrical signals of different frequencies (namely, the electrical signal Sd1-Sdx) to the acoustic transducers DUT1-DUTx, the processing circuit 112 or the sound sensing devices 116 can distinguish each of the sound waves Wp1-Wpx, because the sound waves Wp1-Wpx produced from the acoustic transducers DUT1-DUTx have different frequencies respectively. In this way, audio performance of each of the acoustic transducers DUT1-DUTx can be determined. The acoustic testing apparatus 110 may check whether the acoustic transducers DUT1-DUTx within the wafer 100 are able to produce sound by detecting the sound waves Wp1-Wpx. The acoustic testing apparatus 110 may detect the sound waves Wp1-Wpx by, for example, determining what component frequencies are present in the electrical signals Ss from the sound sensing device(s) 116.

When a sound wave (for example, the sound wave Wp1) is generated, it may produce its own fundamental and some harmonic due to nonlinear behavior. In other words, the output of the acoustic transducer (for example, the acoustic transducer DUT1) has not only a component at the fundamental frequency, which is present at the input of the acoustic transducer, but also some of its harmonic. Therefore, each of the electrical signals Sd1-Sdx may have a frequency different from a harmonic frequency or a fundamental frequency of another of the electrical signals Sd1-Sdx. By the same token, each of the sound waves Wp1-Wpx may have a frequency different from a harmonic frequency or a fundamental frequency of another of the sound waves Wp1-Wpx. Alternatively, each of the electrical signals Sd1-Sdx (or the sound waves Wp1-Wpx) may have a frequency corresponding to a prime number respectively.

Figure 7:
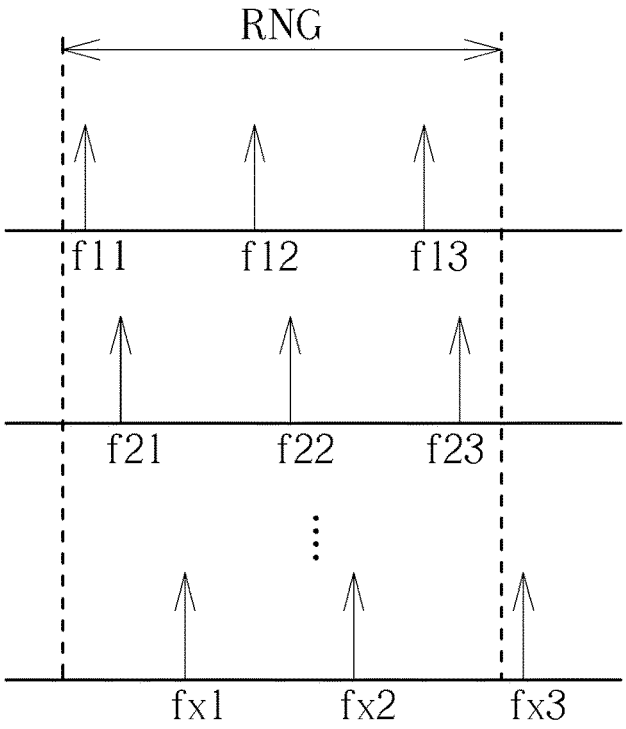
FIG. 7 and FIG. 8 are schematic diagrams of spectrum according to embodiments of the present invention respectively.
Figure 8:
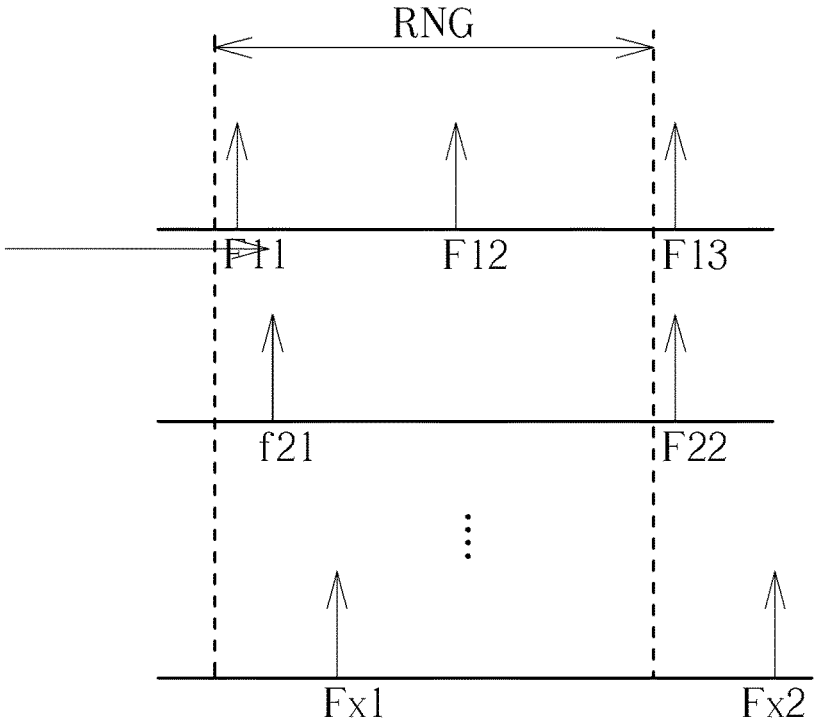

Specifically, FIG. 7 and FIG. 8 are schematic diagrams of spectrum according to embodiments of the present invention. As shown in FIG. 7, a fundamental frequency f11 and harmonic frequencies f12, f13 are related to each other by simple whole number ratios. For example, the harmonic frequencies f12 (also referred to as the frequency of the second harmonic) is two times the fundamental frequency f11 (also referred to as the frequency of the first harmonic). However, fundamental frequencies f21, fx1 and harmonic frequencies f22, f23, fx2, fx3 are unrelated to the fundamental frequency f11 or the harmonic frequencies f12, f13. By properly assigning frequencies to the electrical signals Sd1-Sdx (or the sound waves Wp1-Wpx), the processing circuit 112 or the sound sensing devices 116 can distinguish between the sound waves Wp1-Wpx, because the harmonic frequencies of each of the sound waves Wp1-Wpx produced from the acoustic transducers DUT1-DUTx respectively would not be the same as the fundamental frequency or the harmonic frequencies of another of the sound waves Wp1-Wpx so as to avoid interference.

As shown in FIG. 8, a harmonic frequency F21 (also referred to as second harmonic frequency) corresponding to a fundamental frequency F21 may be equal to a harmonic frequency F13 (also referred to as third harmonic frequency) corresponding to a fundamental frequency F11. However, within a frequency range RNG of the acoustic testing, fundamental frequencies F11, F21, Fx1 and harmonic frequency F12 are unrelated to one another. Harmonic frequencies outside the frequency range RNG (for example, harmonic frequency F13, F22, Fx2) may not be analyzed by the processing circuit 112. The processing circuit 112 would not be confused by the harmonic frequency F21 corresponding to the fundamental frequency F21 and the harmonic frequency F13 corresponding to the fundamental frequency F11. By properly assigning frequencies to the electrical signals Sd1-Sdx (or the sound waves Wp1-Wpx), the processing circuit 112 or the sound sensing devices 116 can distinguish between the sound waves Wp1-Wpx, because the harmonic frequencies of each of the sound waves Wp1-Wpx produced from the acoustic transducers DUT1-DUTx respectively would not be the same as the fundamental frequency or the harmonic frequencies of another of the sound waves Wp1-Wpx within the frequency range RNG so as to avoid interference.

In FIG. 6, the processing circuit 112 may control the operation of the probe card 311 or the sound sensing devices 116. For example, the processing circuit 112 may instruct the probe card 311 to send the electrical signal Sd out. The processing circuit 112 may initiate the detection operation of the sound sensing devices 116 and receive the electrical signal Ss from the sound sensing devices 116. The processing circuit 112 may be coupled to the probe card 311 or the sound sensing devices 116. Alternatively, the processing circuit 112 may be integrated into the probe card 311, the frame 318, or any of the sound sensing devices 116.

As shown in FIG. 6, the processing circuit 112 may comprise an audio recording circuit 612R, a digital signal processing circuit 612P, a determining circuit 612D, a signal generating circuit 612G, and an amplifier 612M. The audio recording circuit 612R may receive and record the electrical signal(s) Ss from the sound sensing device(s) 116. After the digital signal processing circuit 612P analyzes the output of the audio recording circuit 612R, the determining circuit 612D may evaluate the audio performance of the acoustic transducers DUT1-DUTx. The digital signal processing circuit 612P may be a digital signal processor (DSP), and the determining circuit 612D may be a processor or a microcontroller (MCU). The determining circuit 612D may instruct the signal generating circuit 612G to generate signals, which are then converted into the electrical signals Sd1-Sdx by the amplifier 612M. In some embodiments, the processing circuit 112 may further comprise a simple multiplexer-type (MUX-type) addressing circuit so that merely one acoustic transducer is turned on at a time.

In summary, the acoustic testing apparatus of the present invention may detect a sound wave so as to verify acoustic functionality of an acoustic transducer at wafer level before the conventional wafer dicing process. Unlike the conventional acoustic testing always performed after the conventional wafer dicing process, the acoustic testing apparatus of the present invention may perform both the acoustic testing and the conventional wafer testing process at wafer level (before the conventional wafer dicing process) to increase testing efficiency and smoothen overall process.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An acoustic testing method, comprising:

providing an electrical signal to a die within a wafer, wherein the wafer comprises a plurality of dies as a plurality of acoustic transducers, and the electrical signal is provided to the die as an acoustic transducer within the wafer; and receiving a sound wave directly generated by the die as the acoustic transducer within the wafer according to the electrical signal applied to the wafer before a dicing process is performed on the wafer, and generating a sensing result by a sensing device for determining an acoustic functionality of the die as the acoustic transducer before the dicing process is performed on the wafer;

wherein the acoustic functionality of the die comprises an ability of the die to produce audible sound.

2. The acoustic testing method of claim 1, wherein the step of receiving the sound wave and generating the sensing result by a sensing device for determining the acoustic functionality of the acoustic transducer comprises:

converting the sound wave produced by the acoustic transducer within the wafer into a second electrical signal; and analyzing the second electrical signal to verify the acoustic functionality of the acoustic transducer.

3. The acoustic testing method of claim 1, wherein the step of determining the acoustic functionality of the acoustic transducer comprises:

determining whether a sound pressure level of the sound wave produced by the acoustic transducer within the wafer exceeds a certain threshold; or determining whether distortion is created or increased in the sound wave produced by the acoustic transducer.

4. The acoustic testing method of claim 1, further comprising:

providing a plurality of electrical signals to the wafer, wherein the plurality of electrical signals is provided to a plurality of first acoustic transducers within the wafer simultaneously; and receiving a plurality of sound waves generated by the plurality of first acoustic transducers, respectively, and generating a plurality of sensing results by a sensing device for determining acoustic functionalities of the plurality of first acoustic transducers.

5. The acoustic testing method of claim 4, wherein a first frequency of a first electrical signal for a first die within the wafer as a first acoustic transducer is different from a second frequency of a second electrical signal for a second die within the wafer as a second acoustic transducer.

6. The acoustic testing method of claim 4, wherein a first sound wave produced by a first die within the wafer as a first acoustic transducer has a frequency different from a harmonic frequency or a fundamental frequency of a second sound wave produced by a second die within the wafer as a second acoustic transducer, or wherein a first electrical signal for the first die within the wafer as the first acoustic transducer has a frequency different from a harmonic frequency or a fundamental frequency of a second electrical signal for the second die within the wafer as the second acoustic transducer.

7. The acoustic testing method of claim 1, further comprising:

moving the wafer laterally, wherein the plurality of acoustic transducers are triggered in sequence according to movement of the wafer.

8. The acoustic testing method of claim 1, further comprising:

performing wafer sort, wafer final test, electronic die sort, or circuit probe at wafer level to check whether the plurality of acoustic transducers meet electrical characteristics requirements.

9. The acoustic testing method of claim 1, wherein an enclosure or an acoustic resonator is absent from the acoustic transducer when receiving the sound wave generated by the acoustic transducer.

10. The acoustic testing method of claim 1, wherein the acoustic functionality of the die within the wafer comprises one of an audible sound intensity, an audible sound quality, and an audible sound spectral measurement corresponding to the die within the wafer.

11. An acoustic testing system, comprising:

a wafer, wherein a plurality of dies as a plurality of acoustic transducers is formed within the wafer, and a die as an acoustic transducer within the wafer receives an electrical signal; and a sound sensing device, configured to receive a sound wave directly generated by the die as the acoustic transducer within the wafer according to the electrical signal applied to the wafer before a dicing process is performed on the wafer, and generate a sensing result for determining an acoustic functionality of the die as the acoustic transducer before the dicing process is performed on the wafer;

wherein the acoustic functionality of the die comprises an ability of the die to produce audible sound.

12. The acoustic testing system of claim 11, wherein the sound wave produced by the acoustic transducer within the wafer is converted into a second electrical signal, and the second electrical signal is analyzed to verify the acoustic functionality of the acoustic transducer.

13. The acoustic testing system of claim 11, wherein whether a sound pressure level of the sound wave produced by the acoustic transducer within the wafer exceeds a certain threshold or whether distortion is created or increased in the sound wave produced by the acoustic transducer is determined.

14. The acoustic testing system of claim 11, wherein a plurality of first acoustic transducers within the wafer receive a plurality of electrical signals simultaneously, and the sound sensing device receives a plurality of sound waves generated by the plurality of first acoustic transducers according to the plurality of electrical signals, respectively, and generates a plurality of sensing results for determining acoustic functionalities of the plurality of first acoustic transducers.

15. The acoustic testing system of claim 14, wherein a first frequency of a first electrical signal for a first die within the wafer as a first acoustic transducer is different from a second frequency of a second electrical signal for a second die within the wafer as a second acoustic transducer.

16. The acoustic testing system of claim 14, wherein a first sound wave produced by a first die within the wafer as a first acoustic transducer has a frequency different from a harmonic frequency or a fundamental frequency of a second sound wave produced by a second die within the wafer as a second acoustic transducer, or wherein a first electrical signal for the first die within the wafer as the first acoustic transducer has a frequency different from a harmonic frequency or a fundamental frequency of a second electrical signal for the second die within the wafer as the second acoustic transducer.

17. The acoustic testing system of claim 11, further comprising:

a probe card; and a plurality of sound sensing devices, configured to receive the sound wave generated by the acoustic transducer according to the electrical signal, and generate the sensing result for determining the acoustic functionality of the acoustic transducer, wherein the plurality of sound sensing devices are located on the probe card or a frame above the probe card.

18. The acoustic testing system of claim 17, wherein the probe card is configured to provide the electrical signal to the wafer and perform wafer sort, wafer final test, electronic die sort, or circuit probe at wafer level to check whether the plurality of acoustic transducer meet electrical characteristics requirements.

19. The acoustic testing system of claim 11, further comprising at least one of:

a noise isolation cover, configured to surround the plurality of acoustic transducer so as to increase signal to noise ratio; and a probe chuck, configured to support or move the wafer, wherein the plurality of acoustic transducers are triggered in sequence according to movement of the wafer.

20. The acoustic testing system of claim 11, wherein an enclosure or an acoustic resonator is absent from the acoustic transducer when receiving the sound wave generated by the acoustic transducer.

21. The acoustic testing system of claim 11, wherein the acoustic functionality of the die within the wafer comprises one of an audible sound intensity, an audible sound quality, and an audible sound spectral measurement corresponding to the die within the wafer.

* * * * *